US010699654B2

(12) United States Patent
Lim et al.

(10) Patent No.: US 10,699,654 B2
(45) Date of Patent: Jun. 30, 2020

(54) RESET CIRCUIT, DISPLAY DEVICE, AND DRIVING METHOD THEREFOR

(71) Applicant: LG DISPLAY CO., LTD., Seoul (KR)

(72) Inventors: Kyungho Lim, Paju-si (KR); Hongmuk Lim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 18 days.

(21) Appl. No.: 15/677,547

(22) Filed: Aug. 15, 2017

(65) Prior Publication Data

US 2018/0053480 A1 Feb. 22, 2018

(30) Foreign Application Priority Data

Aug. 22, 2016 (KR) ..... 10-2016-0106356

(51) Int. Cl.

| | |
|---|---|
| ***G09G 3/36*** | (2006.01) |
| ***G09G 3/20*** | (2006.01) |
| ***G09G 3/292*** | (2013.01) |
| ***G09G 3/3225*** | (2016.01) |
| ***G09G 3/3266*** | (2016.01) |

(52) U.S. Cl.

CPC ..... *G09G 3/3648* (2013.01); *G09G 3/20* (2013.01); *G09G 3/292* (2013.01); *G09G 3/3225* (2013.01); *G09G 3/3266* (2013.01); *G09G 3/3677* (2013.01); *G09G 2310/0245* (2013.01); *G09G 2310/063* (2013.01)

(58) Field of Classification Search

CPC .... G09G 2360/18; G09G 5/003; G09G 5/006; G09G 2340/0435; G06F 1/3265

See application file for complete search history.

(56) References Cited

U.S. PATENT DOCUMENTS

| | | | | |
|---|---|---|---|---|
| 9,196,192 | B2 | 11/2015 | Kim | |
| 2006/0101295 | A1* | 5/2006 | Park | G06F 1/26 713/300 |
| 2009/0058487 | A1* | 3/2009 | Rho | H03H 11/265 327/261 |
| 2010/0013867 | A1* | 1/2010 | Kim | G09G 3/3233 345/690 |
| 2011/0115307 | A1* | 5/2011 | Yoshie | G06F 1/26 307/125 |

(Continued)

FOREIGN PATENT DOCUMENTS

CN 103514830 A 1/2014

*Primary Examiner* — Yunzhen Shen

(74) *Attorney, Agent, or Firm* — Seed IP Law Group LLP

(57) ABSTRACT

A display device includes: a display panel; a gate driving unit and a data driving unit; a controller; and a reset circuit. The reset circuit is configured to generate a first reset signal corresponding to an operation of the display panel in one of a first driving mode or a second driving mode, and a second reset signal corresponding to a switch from the first driving mode to the second driving mode or a switch from the second driving mode to the first driving mode. The reset circuit provides the reset signals to the controller to control the first driving mode and the second driving mode of the display panel. The display device may thus switch between first and second driving modes during operation in either of the first or second driving modes, thereby improving a stain and a color difference of a displayed image.

13 Claims, 13 Drawing Sheets

(56) References Cited

U.S. PATENT DOCUMENTS

| | | | | |
|---|---|---|---|---|
| 2013/0293600 | A1* | 11/2013 | Lee | G09G 3/3258 345/691 |
| 2013/0335396 | A1* | 12/2013 | Kim | G09G 3/3208 345/212 |
| 2015/0103104 | A1* | 4/2015 | Lee | G09G 3/3648 345/690 |
| 2015/0161952 | A1* | 6/2015 | Iguchi | G09G 3/3406 345/691 |
| 2015/0194086 | A1* | 7/2015 | Kim | G09G 3/3688 345/214 |
| 2015/0312854 | A1* | 10/2015 | Iwaki | H04W 52/0229 455/574 |
| 2017/0039981 | A1* | 2/2017 | Hwang | G09G 3/3696 |
| 2017/0124958 | A1* | 5/2017 | Pyo | G09G 3/3233 |

* cited by examiner

FIG.6

| input | | output |
|---|---|---|
| A | B | C |
| 0 | 0 | 1 |
| 1 | 0 | 0 |
| 0 | 1 | 0 |
| 1 | 1 | 1 |

RESET CIRCUIT, DISPLAY DEVICE, AND DRIVING METHOD THEREFOR

CROSS REFERENCE TO RELATED APPLICATION

This application claims priority from Korean Patent Application No. 10-2016-0106356, filed on Aug. 22, 2016, which is hereby incorporated by reference for all purposes as if fully set forth herein.

BACKGROUND

Technical Field

The present embodiments relate to a reset circuit, a display device, and a driving method therefor.

Description of the Related Art

As society develops into an information-based society, display devices for displaying an image are being increasingly provided in various forms, and in recent years, various display devices such as Liquid Crystal Display (LCD), Plasma Display Panel (PDP), and Organic Light Emitting Display Device (OLED) have been utilized.

Generally, a display device includes a display panel for displaying an image, a driver integrated circuit (IC) for supplying a gate signal and a data signal to the display panel, and a controller for supplying various control signals to the driver.

When a source voltage is supplied to the display device, the controller is activated by a reset signal (RESET) supplied from a reset circuit, and generates various control signals. Also, the controller receives image data provided from the outside, converts the image data to image data which can be displayed on the display panel, and outputs the image data.

A reset signal (RESET) output from the reset circuit initializes the controller to operate a driving mode that displays an image, and the controller operates internal logics (Logic) and reads data stored in a memory in response to a "high" section of the reset signal, and generates various control signals based thereon.

When a reset signal (RESET) of a reset circuit is supplied to the controller, the controller performs an operation of reading compensation data or the like stored in the memory, after a predetermined period of time (e.g., several to several tens of milliseconds (ms)). This is to perform compensation associated with image data that is displayed according to a driving mode of the display panel, and thus, the quality of the image is improved.

Particularly, the display device has adapted various functions recently to meet consumer demand. For example, the display device may perform a forward operation, a reverse operation, or maintain a pause operation.

The forward operation is an operation of displaying an image on the display panel in a normal state. The reverse operation is an operation of displaying an image upside down, with respect to "normal" state during the forward operation, on the display panel. The pause operation is an operation that pauses a displayed image and maintains the paused image during a predetermined period of time.

When the display device proceeds with the forward operation, the reverse operation, or the pause operation, a reset signal for switching between each operation is needed.

However, when a second reset signal (RESET2) for the reverse operation is supplied in the state in which a first reset signal (RESET1) supplied for the forward operation maintains a "high" state, the first reset signal (RESET1) in a "high" state needs to be dropped to a "low state" and needs to be raised to a "high" state again. Therefore, a source voltage needs to be turned off or the controller needs to be turned off in order to switch from the forward operation to the reverse operation, which is a drawback.

That is, according to the conventional technology, the display device is incapable of switching to the reverse operation in the middle of the forward operation, and is incapable of switching to the forward operation in the middle of the reverse operation. Therefore, although operation of the display device in the reverse operation may improve a stain or a color difference occurring in an image provided in the forward operation, this cannot be realized without turning off the source voltage or the controller.

Also, according to the conventional technology, the display device is incapable of switching to another mode while operating in a predetermined mode, and thus, the display device cannot satisfy the needs of customers.

BRIEF SUMMARY

In various embodiments, the present disclosure provides a reset circuit, a display device, and a method, which enables the display device to switch to a second driving mode in the middle of the operation in a first driving mode, or to switch to the first driving mode in the middle of the operation in the second driving mode, thereby improving a stain and a color difference of a displayed image.

The present disclosure further provides a reset circuit, a display device, and a method, which generates a secondary reset signal to enable the display device to switch to another driving mode in the middle of the operation in a predetermined mode, thereby improving a poor image quality provided in the predetermined driving mode using the another driving mode.

A reset circuit for a display device according to the present embodiments may include a driving mode selection circuit that, in operation, receives a driving mode selection signal corresponding to at least one of a first driving mode and a second driving mode of the display device, and outputs an enable signal based on the driving mode selection signal, and a reset signal generator that generates a reset signal based on the enable signal output from the driving mode selection circuit.

In the reset circuit according to one or more embodiments of the present disclosure, the driving mode selection circuit outputs the enable signal in response to a switch in the operation of the display device from one of the first driving mode and the second driving mode to the other of the first driving mode and the second driving mode, and the reset signal generator generates a first reset signal and a second reset signal corresponding to the enable signal output from the driving mode selection circuit.

In one or more embodiments, the driving mode selection circuit may include a signal delaying circuit that receives the driving mode selection signal and outputs a delayed driving mode selection signal, and a logical operator having a first terminal that receives the driving mode selection signal, and a second terminal that receives the delayed driving mode selection signal, the logical operator performs a logical operation based on the driving mode selection signal and the delayed driving mode selection signal, and outputs the enable signal based on the logical operation.

In one or more embodiments, the signal delaying circuit may include a resistor and a capacitor, and the resistor may have a first terminal coupled to the driving mode selection signal and a second terminal coupled to the capacitor and to the second terminal of the logical operator.

In one or more embodiments, the logical operator may be an exclusive NOR (XNOR) logic gate.

In one or more embodiments, the driving mode selection signal corresponds to the first driving mode when the driving mode selection signal is a logical "high" and the driving mode selection signal corresponds to the second driving mode when the driving mode selection signal is a logical "low", and the reset signal generator may generate a first reset signal as a first logical "high" signal corresponding to operation of the display device in either one of the first driving mode or the second driving mode.

In one or more embodiments, when the display device is switched from the first driving mode to the second driving mode, or from the second driving mode to the first driving mode, the reset signal generator may generate a second reset signal as a second logical "high" signal.

In one or more embodiments, the reset signal generator receives a source voltage, and the source voltage is maintained at a same voltage level during generation of the first and the second reset signals by the reset signal generator.

A display device according to the present embodiments may include: a display panel; a gate driving unit and a data driving unit, the gate driving unit and the data driving unit configured to drive the display panel; a controller configured to control the gate driving unit and the data driving unit; and a reset circuit configured to: generate a first reset signal corresponding to an operation of the display panel in one of a first driving mode or a second driving mode, generate a second reset signal corresponding to a switch from the first driving mode to the second driving mode, or corresponding to a switch from the second driving mode to the first driving mode, and provide the first and the second reset signals to the controller to control the operation of the display panel in the first driving mode and the second driving mode.

In one or more embodiments, the display device may further include a compensation unit coupled to the reset circuit and to the controller, the compensation unit configured to receive the first and the second reset signals, and to supply compensation data corresponding to the first driving mode or the second driving mode to the controller in response to the received first and second reset signals.

The display device may further include a computer-readable memory that stores first compensation data associated with the first driving mode and second compensation data associated with the second driving mode, and the compensation unit selectively supplies one of the first compensation data and the second compensation data to the controller, based on the first and the second reset signals.

In one or more embodiments, the reset circuit of the display device may include a driving mode selection circuit configured to receive a driving mode selection signal corresponding to the operation of the display panel in at least one of the first driving mode and the second driving mode, and to output an enable signal based on the driving mode selection signal, and a reset signal generator configured to generate a reset signal in response to the enable signal output from the driving mode selection circuit.

In one or more embodiments, the driving mode selection circuit may include a signal delaying circuit configured to receive the driving mode selection signal and to output a delayed driving mode selection signal, and a logical operator configured to receive the driving mode selection signal and the delayed driving mode selection signal, and to perform a logical operation based on the driving mode selection signal and the delayed driving mode selection signal.

The logical operator may be an exclusive NOR (XNOR) logic gate.

In one or more embodiments, the driving mode selection signal corresponds to operation of the display panel in the first driving mode when the driving mode selection signal is a logical "high" and the driving mode selection signal corresponds to operation of the display panel in the second driving mode when the driving mode selection signal is a logical "low", and the reset signal generator may generate the first reset signal as a first logical "high" signal corresponding to operation of the display panel in either one of the first driving mode or the second driving mode.

In one or more embodiments, when the display panel is switched from the first driving mode to the second driving mode, or from the second driving mode to the first driving mode, the reset signal generator may generate the second reset signal as a second logical "high" signal, and enables the controller to control the display panel in a different driving mode.

The reset signal generator may receive a source voltage, and the source voltage is maintained at a same voltage level during generation of the first and the second reset signals by the reset signal generator.

In one or more embodiments, the first driving mode is a forward operation in which an image is displayed on the display panel in a first state, and the second driving mode is a reverse operation in which the image is displayed on the display panel in a second state, the second state having an orientation that is upside down with respect to the first state.

In yet further embodiments, the present disclosure provides a method that includes: generating a first reset signal based on a driving mode selection signal corresponding to a selected operation of a display panel in one of a first driving mode or a second driving mode; operating the display panel in the first driving mode or the second driving mode based on the first reset signal; generating a second reset signal, based on the driving mode selection signal, corresponding to a switch of the display panel from the one of the first driving mode or the second driving mode to the other of the first driving mode or the second driving mode; and operating, based on the second reset signal, the display panel in the other of the first driving mode or the second driving mode.

In one or more embodiments, the first driving mode is a forward operation in which an image is displayed on the display panel in a first state, and the second driving mode is a reverse operation in which the image is displayed on the display panel in a second state, the second state having an orientation that is upside down with respect to the first state.

In one or more embodiments, the display panel maintains operation in the one of the first driving mode or the second driving mode, based on the first reset signal, until the display panel is switched to the other of the first driving mode or the second driving mode, based on the second reset signal.

A reset circuit, a display device, and a driving method thereof according to the present embodiments may enable the display device to switch to a second driving mode in the middle of the operation in a first driving mode or to switch to the first driving mode in the middle of the operation in the second driving mode, thereby improving a stain and a color difference of a displayed image.

Also, a reset circuit, a display device, and a driving method thereof according to the present embodiments may generate a secondary reset signal to enable the display device to switch to another driving mode in the middle of the operation in a predetermined driving mode, thereby improving a poor image quality provided in the predetermined driving mode using the other driving mode.

BRIEF DESCRIPTION OF THE SEVERAL VIEWS OF THE DRAWINGS

The above and other objects, features and advantages of the present disclosure will be more apparent from the following detailed description taken in conjunction with the accompanying drawings, in which:

FIG. 6 is a diagram illustrating a logical operation table of an operator disposed in an operation unit of a reset circuit according to embodiments of the present disclosure;

DETAILED DESCRIPTION

Figure 1:
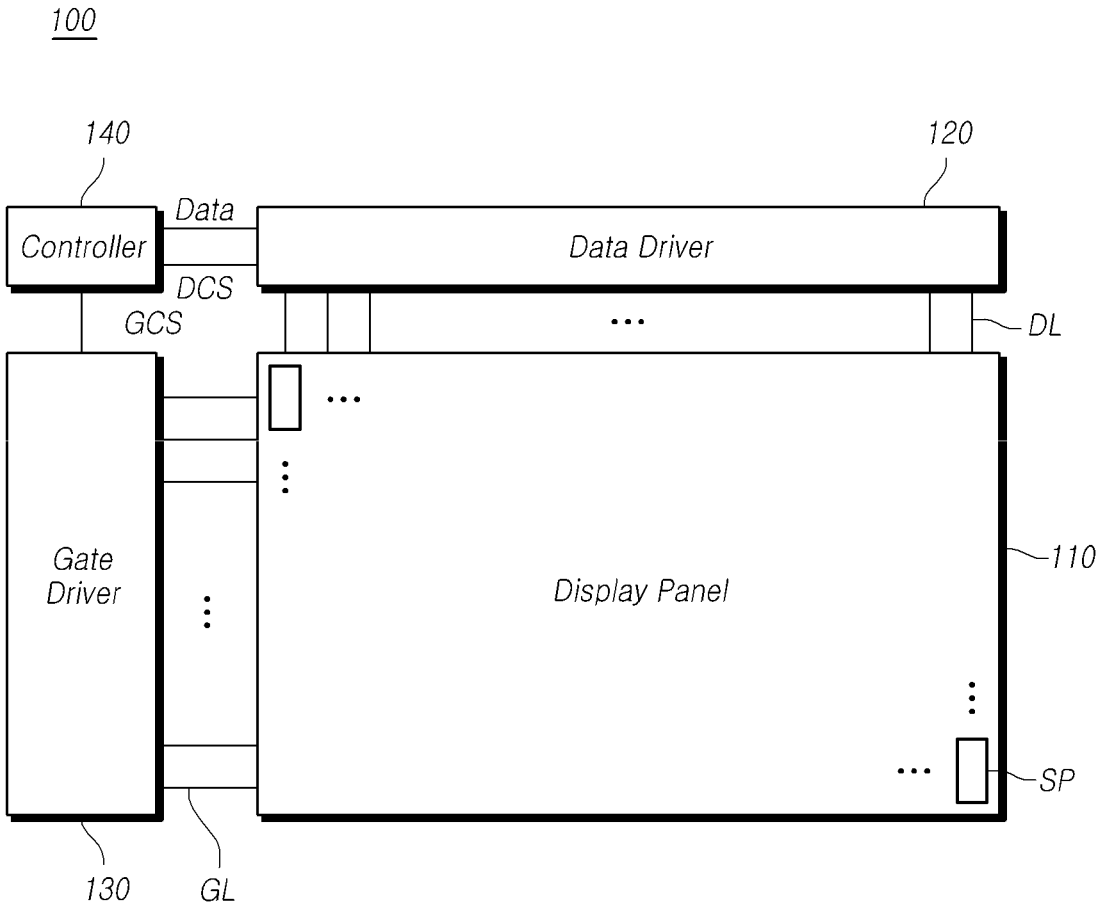
FIG. 1 is a system diagram illustrating a display device according to one or more embodiments of the present disclosure.

The advantages and features of the present disclosure and methods of achieving the same will be apparent by referring to embodiments of the present disclosure as described below in detail in conjunction with the accompanying drawings. However, the present disclosure is not limited to the embodiments set forth below, but may be implemented in various different forms. The following embodiments are provided only as examples of the present disclosure, and the present disclosure is defined only by the scope of the appended claims.

The shapes, sizes, ratios, angles, numbers, and the like shown in the drawings for explaining embodiments of the present disclosure are illustrative, and therefore the present disclosure is not limited to the shown matters. Throughout the specification, the same or like reference numerals designate the same or like elements. Further, in the description of the present disclosure, when a detailed description of the related well-known technologies would unnecessarily make the subject matter of the present disclosure unclear, then such a detailed description of the known technologies will be omitted.

When the expression "include", "have", "comprise", or the like as mentioned herein is used, any other part may be added unless explicitly limited, for example, by the expression "only". When an element is expressed in the singular form, it should be understood that the element covers the plural form unless the element is explicitly described as being limited to only the singular form.

It should be construed that an element includes an error range when interpreting the element, unless otherwise indicated.

In the description of the relation of positions, for example, when the relation of positions of two parts are described using terms, such as, "on", "at the top of", "under", "next to", and the like, one or more other parts may be disposed between the two parts unless explicitly limited by terms such as "immediately" or "directly".

In the description of the relation of time, for example, when the order of incidents is described using terms, such as "after", "subsequent to", "next to", "before", and the like, the incidents may not be performed in direct succession unless explicitly limiting terms such as "immediately" or "direct" are used.

It should be construed that, although the terms, 'first', 'second', and the like are used to describe various elements, these elements should not be limited by such terms. The terms are only used to distinguish one element from another. Therefore, a first element could be termed a second element within the technical idea of the present disclosure.

Some or all of the features of various embodiments of the present disclosure can be combined or mixed, and can be reliably operated and driven in various technical schemes. The embodiments can be implemented independently from one another or can be reliably implemented together.

Hereinafter, embodiments of the present disclosure will be described in detail with reference to the accompanying drawings. Also, in the drawings, the size, thickness, and the like of a device may be exaggeratedly represented for the convenience of description. Throughout the specification, the same reference numerals designate the same elements.

FIG. 1 is a system diagram illustrating a display device according to one or more embodiments.

Referring to FIG. 1, a display device 100 according to embodiments of the present disclosure may include: a display panel 110 on which a plurality of data lines (DL) and a plurality of gate lines (GL) are disposed, and a plurality of sub-pixels (SP), which are defined by the plurality of data lines (DL) and the plurality of gate lines (GL), are disposed; a data driver 120 for driving the plurality of data lines (DL); a scan driver 130 for driving the plurality of gate lines (GL); and a controller 140 for controlling the data driver 120 and the scan driver 130.

The controller 140 supplies various types of control signals to the data driver 120 and the gate driver 130 to control the data driver 120 and the gate driver 130.

The controller 140 starts a scan according to timing implemented in each frame, converts input image data received from the outside according to a data signal format used in the data driver 120, outputs the converted image data, and controls data driving according to a proper time based on the scan.

The controller 140 may be a timing controller used in a general display technology or a control device that includes the timing controller and further performs another control function.

The data driver 120 drives the plurality of data lines (DL) by supplying a data voltage to the plurality of data lines (DL). Here, the data driver 120 may also be referred to as a "source driver".

The data driver 120 may include at least one Source Driver Integrated Circuit (SDIC) and drives the plurality of data lines.

The scan driver 130 may sequentially supply scan signals to the plurality of gate lines (GL) and sequentially drive the plurality of gate lines (GL). Here, the gate driver 130 may also be referred to as a "scan driver".

The scan driver 130 may include at least one Gate Driver Integrated Circuit (GDIC).

The scan driver 130 sequentially supplies scan signals of an on-voltage or an off-voltage to the plurality of gate lines (GL) under control of the controller 140.

When a particular gate line is open by the scan driver 130, the data driver 120 converts the image data received from the controller 140 into an analog type data voltage and supplies the converted data voltage to the plurality of data lines (DL).

Although the data driver 120 is shown in FIG. 1 as being located at only one side (e.g., the upper or lower side) of the display panel 110, the data driver 120 may be located on both sides (e.g., the upper and lower side) of the display panel 110 according to a driving scheme, a panel design scheme, or the like.

Similarly, although the scan driver 130 is shown in FIG. 1 as being located at only one side (e.g., left side or right side) of the display panel 110, the scan driver 130 may be located at both sides (e.g., left side or right side) of the display panel 110 according to a driving scheme, a panel design scheme, or the like.

The controller 140 receives various timing signals including a vertical synchronization signal (Vsync), a horizontal synchronization signal (Hsync), an input data enable (DE) signal, a clock signal (CLK), and the like, together with input image data, from the outside (e.g., a host system).

In order to control the data driver 120 and the scan driver 130, the controller 140 receives timing signals, such as the vertical synchronization signal (Vsync), the horizontal synchronization signal (Hsync), the input DE signal, the clock signal, and the like to generate various control signals and output the generated control signals to the data driver 120 and the gate driver 130.

For example, in order to control the gate driver 130, the controller 140 outputs various Gate Control Signals (GCSs) including a Gate Start Pulse (GSP), a Gate Shift Clock (GSC), a Gate Output Enable (GOE) signal, and the like.

Here, the GSP controls an operation start timing of one or more gate driver ICs included in the scan driver 130. The GSC is a clock signal that is commonly input to one or more gate driver integrated circuits, and may control a shift timing of a scan signal (gate pulse). The GOE signal designates timing information of one or more gate driver integrated circuits.

Further, in order to control the data driver 120, the controller 140 outputs various Data Control Signals (DCS) including a Source Start Pulse (SSP), a Source Sampling Clock (SSC), a Source Output Enable (SOE) signal, and the like.

Here, the SSP controls a data sampling start timing of one or more source driver integrated circuits included in the data driver 120. The SSC is a clock signal that controls a sampling timing of data in each source driver integrated circuit. The SOE controls an output timing of the data driver 120.

As mentioned above, the data driver 120 may include at least one Source Driver Integrated Circuit (SDIC) and drives the plurality of data lines.

Each SDIC may be connected to a bonding pad of the display panel 110 based on a Tape Automated Bonding (TAB) scheme or a Chip On Glass (COG) scheme, or may be directly disposed on the display panel 110. In some cases, the SDIC may be disposed within, and integrated with, the display panel 110. Further, each SDIC may be implemented in a Chip On Film (COF) type in which the SDIC is mounted on a film connected to the display panel 110.

Each SDIC may include a shift register, a latch circuit, a Digital to Analog Converter (DAC), an output buffer, and the like.

Each SDIC may further include an Analog to Digital Converter (ADC) according to circumstances.

As mentioned above, the scan driver 130 may include at least one Gate Driver Integrated Circuit (GDIC).

Each GDIC may be connected to a bonding pad of the display panel 110 based on a Tape Automated Bonding (TAB) scheme or a Chip On Glass (COG) scheme, or may be implemented in a Gate In Panel (GIP) type and may be directly disposed in the display panel 110. In some cases, the GDIC may be disposed in, and integrated with, the display panel 110. Further, each GDIC may be implemented in a COF type in which the GDIC is mounted on a film connected to the display panel 110.

Each GDIC may include a shift register, a level shifter, and the like.

The display device 100 according to present embodiments may include at least one Source Printed Circuit Board (S-PCB) for circuit connection of at least one SDIC, and a Control Printed Circuit Board (C-PCB) for mounting control elements and various electronic devices.

At least one SDIC may be mounted on at least one S-PCB, or a film on which at least one SDIC is mounted may be connected to the at least one S-PCB.

On the C-PCB, the controller 140 for controlling operations of the data driver 120 and the gate driver 130, and a power controller for supplying various voltages or currents to the display panel 110, the data driver 120, and the scan driver 130 or controlling the various voltages or currents to be supplied may be mounted.

At least one S-PCB and a C-PCB may be connected in a circuit manner through at least one connection member.

The connection member may be a Flexible printed Circuit (FPC), a Flexible Flat Cable (FFC), or the like.

At least one S-PCB and a C-PCB may be integrated into one printed circuit board.

The display device 100 according to the present embodiments may be a liquid crystal display device, an organic light-emitting display device, a plasma display device, and the like.

Each sub-pixel (SP) disposed on the display panel 110 may include various structures according to a display device type of the display device 100.

For example, when the display panel 110 is an organic light-emitting display panel, each sub-pixel (SP) may include an Organic Light Emitting Diode (OLED) and a circuit element, such as a driving transistor for driving the same.

A type of circuit and the number of circuit elements included in each sub-pixel (SP) may be variously determined according to a provided function and a design type.

Figure 2A:
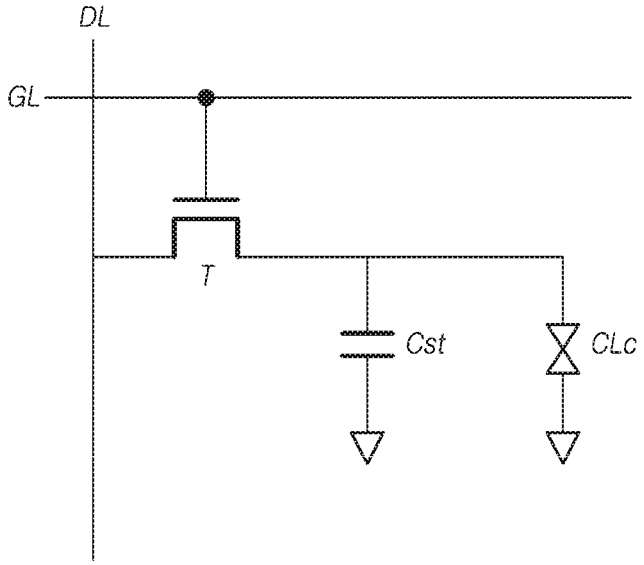
FIGS. 2A and 2B are circuit diagrams illustrating the structure of a sub-pixel of a display device according to embodiments of the present disclosure.
Figure 2B:
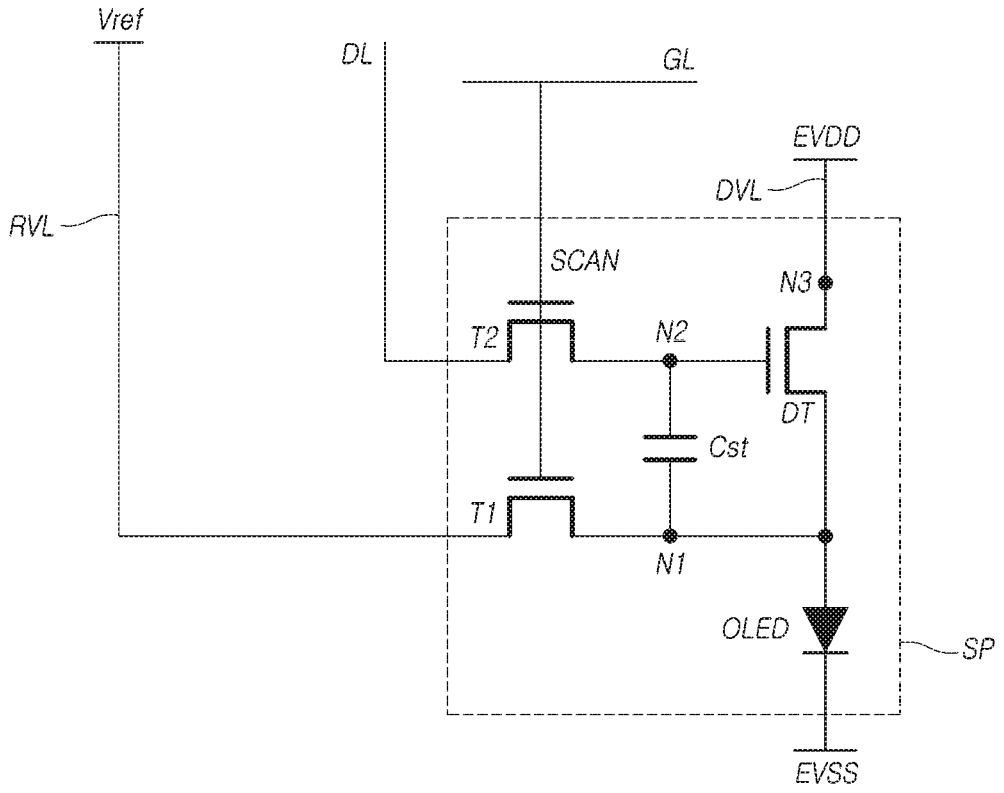

FIGS. 2A and 2B are circuit diagrams illustrating the structure of a sub-pixel of a display device according to embodiments of the present disclosure.

FIG. 2A illustrates a circuit structure of a sub-pixel when a display device according to the present embodiments is a liquid crystal display device. Each sub-pixel (SP) is formed at a respective intersection of a data line (DL) and a gate line (GL), and a thin transistor (T) is disposed on the intersection area of the data line (DL) and the gate line (GL).

Also, a liquid crystal capacitor (Clc) and a storage capacitor (Cst) connected with the thin transistor (T) are disposed on each sub-pixel (SP) area. Although not illustrated, a pixel electrode (not illustrated) and a common electrode (not illustrated) corresponding to the pixel electrode may be disposed on the sub-pixel area.

FIG. 2B illustrates a circuit structure of a sub-pixel when a display device according to the present embodiments is an organic light-emitting display device. Each sub-pixel (SP) may include an Organic Light-Emitting Diode (OLED), a Driving Transistor (DT), a first transistor (T1), a second transistor (T2), a storage capacitor (Cst), and the like.

As shown in FIG. 2B and described above, each sub-pixel includes three transistors (DT, T1, and T2) and one storage capacitor (Cst), and thus, each sub-pixel has a 3 Transistor (3T)-1 Capacitor (1C) structure.

A Driving Voltage Line (DVL), which has not been described although illustrated in the drawing, is a driving voltage line. A driving voltage (EVDD) may be supplied to the driving voltage line (DVL), and a base voltage (EVSS) may be supplied to a terminal (e.g., a cathode) of the organic light-emitting diode (OLED). A Reference Voltage (Vref) may be supplied to a Reference Voltage Line (RVL), as shown.

The first transistor (T1) may be referred to as a "sensing transistor", and the second transistor (T2) may be referred to as a "switching transistor".

The driving transistor (DT) includes a source electrode, a drain electrode, and a gate electrode. The source electrode is coupled to a first node (N1), which may be referred to as a source node, the gate electrode is coupled to a second node (N2), which may be referred to as a gate node, and the drain electrode is coupled to a third node (N3), which may be referred to as a drain node.

Figure 3A:
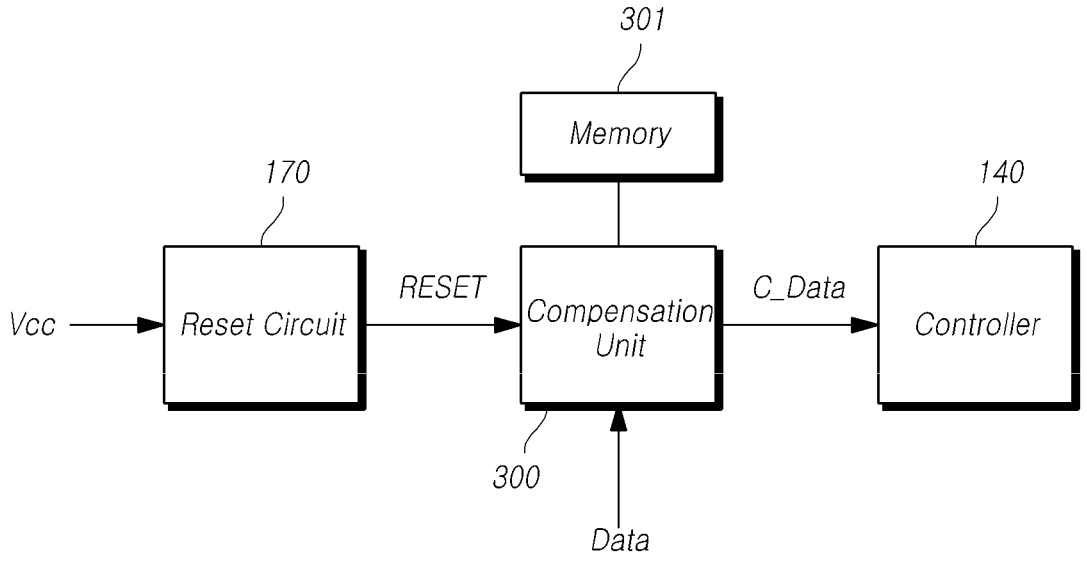
FIG. 3A is a schematic block diagram illustrating the operation in which a controller drives a display device based on a reset signal of a reset circuit according to embodiments of the present disclosure.
Figure 3B:
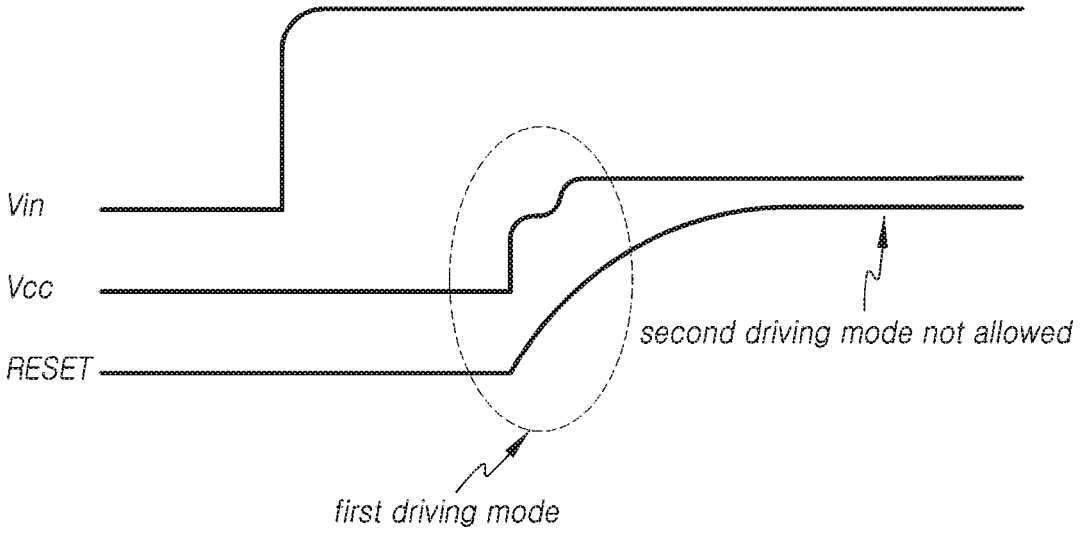
FIG. 3B is a waveform diagram illustrating an operation waveform of a reset circuit according to embodiments of the present disclosure.

FIG. 3A is a block diagram illustrating the operation in which a controller drives a display device according to a reset signal of a reset circuit according to the present embodiments. FIG. 3B is a waveform diagram illustrating an operation waveform of a reset circuit according to the present embodiments.

Referring to FIGS. 3A and 3B, in a display device according to the present embodiments, when a main power (VIN) is provided to the display device 100, a source voltage (Vcc) is supplied to a reset circuit 170, and the reset circuit 170 generates a reset signal (RESET).

Therefore, the display device according to embodiments of the present disclosure may include the reset circuit 170 that operates based on a source voltage (Vcc), a compensation unit 300 that performs compensation associated with data of a driving mode in response to a reset signal (RESET) generated by the reset circuit 170, and a memory 301 that stores compensation data information.

The compensation unit 300 and the memory 301 may be included in the controller 140, or may be disposed independently from the controller 140. Also, the compensation unit 300 and the memory 301 may be included in the reset circuit 170, or may be disposed independently from the reset circuit 170.

As described above, when a source voltage (Vcc) is supplied to the reset circuit 170, the reset circuit 170 generates a reset signal (RESET), and the generated reset signal (RESET) is supplied to the compensation unit 300, which may be configured as an algorithm IC or an integrated circuit that implements one or more compensation algorithms, and thus, compensation data (C_data) is supplied to the controller 140.

The controller 140 may operate the display device in a predetermined driving mode using the compensation data (C_data) supplied through the compensation unit 300. For example, in the case of a forward driving mode in which an image is displayed in a normal state, the display device supplies a reset signal (RESET) to the compensation unit 300 to obtain compensation data (C_data), instead of directly supplying a reset signal to the controller 140 to enable the controller 140 to generate a control signal, and drives the display device using the obtained compensation data, thereby improving an image.

Here, a description will be provided with reference to a process that supplies a reset signal (RESET) generated by the reset circuit 170 to the compensation unit 300, performs compensation associated with image data (Data) using the compensation data (C_Data), and drives a display device.

In response to a reset signal (RESET) received from the reset circuit 170, the compensation unit 300 reads compensation data (C_data) stored in the memory 301, and supplies the compensation data (C_data) to the controller 140. Compensation data for a forward operation and compensation data for a reverse operation are stored in the memory 301 at different addresses.

Therefore, to enable the compensation unit 300 to selectively read the forward operation compensation data and the reverse operation compensation data stored in the memory 301, a separate reset signal (RESET) needs to be generated so that the compensation unit 300 operates in response to each reset signal to switch between reading of the forward operation compensation data and the reverse operation compensation data.

According to the conventional techniques, when the reset circuit 170 generates a primary reset signal (RESET) in a "high" state due to receiving a source voltage (Vcc), the "high" state is maintained and thus, the reset circuit 170 cannot generate a secondary reset signal (RESET). As used herein, a "high" state signal may be a voltage signal corresponding to a logic "high" (e.g., a logical "1"), and a "low" state signal may be a voltage signal corresponding to a logic "low" (e.g., a logical "0").

Referring to FIG. 3B, when a main power (VIN) is provided to the display device, a voltage supplying unit (not illustrated) supplies a source voltage (Vcc) to the reset circuit 170. Therefore, when a source voltage (Vcc) in a "high" state is supplied to the reset circuit 170 after the main power (VIN) in a "high" state is supplied, the reset circuit 170 outputs a reset signal (RESET) that transitions from a "low to high" state in response to the source voltage (Vcc).

As illustrated in the drawing, after a delay time (e.g., an RC Delay of approximately 14 ms) during which the reset signal (RESET) is changed from a "low" state to a "high" state, the compensation unit 300 may read compensation data (C_Data) stored in the memory 301.

For example, when driving in which a reset signal (RESET) in an initial "high" state is referred to as a first driving mode (e.g., a forward operation), the compensation unit 300 reads compensation data (forward compensation data) corresponding to the first driving mode stored in the memory 301 in response to the reset signal (RESET).

When a second driving mode (e.g., a reverse operation) is needed to satisfy customer demand for viewing in another display mode, the compensation unit 300 needs to read compensation data (reverse compensation data) located at an address different from that of the forward compensation data. In this instance, another reset signal (RESET) is needed in order to switch from the first driving mode to the second driving mode.

Also, when the display device operates in the first driving mode or the second driving mode, a stain or a color difference may occur in the display device. In this instance, when the display device switches from the first driving mode to the second driving mode, or switches from the second driving mode to the first driving mode, the stain or the color difference may be improved. Accordingly, the display device may need to switch the driving mode of the display device for improving image quality.

However, to generate a secondary reset signal (RESET) for switching to the second driving mode or the first driving mode while the display device operates in the first driving mode or the second driving mode based on a primary reset signal (RESET), there has been no choice but to turn off the controller 140 that is being operated, and to generate a reset signal (RESET) again, according to the conventional techniques.

Accordingly, the conventional techniques cannot proceed with a reverse operation to improve the quality of a displayed image (stain or color difference) in the forward operation, thereby having a limitation to improvement of the image quality of the display device.

A reset circuit, a display device, and an operation method thereof according to the present embodiments generates a primary reset signal (RESET1) for a first driving mode (forward operation) and a secondary reset signal (RESET2) for a second driving mode (reverse operation) according to an option signal supplied to the reset circuit, and improves a stain or a color difference of a displayed image.

Figure 4:
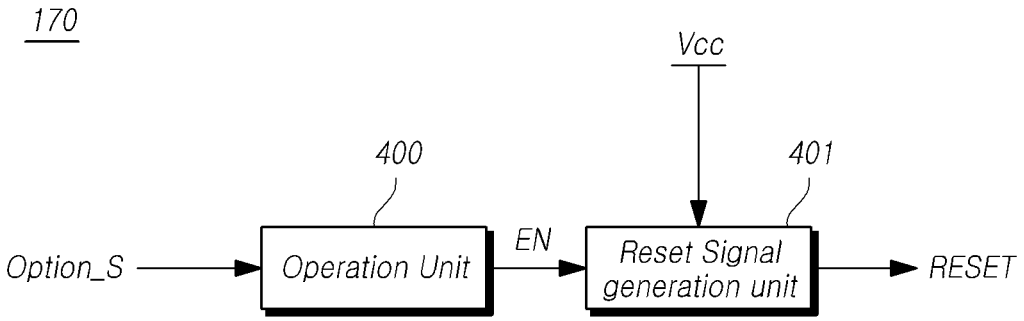
FIG. 4 is a schematic block diagram illustrating the structure of a reset circuit according to embodiments of the present disclosure.

FIG. 4 is a diagram illustrating the structure of a reset circuit according to embodiments of the present disclosure.

Referring to FIG. 4, the reset circuit 170 of the display device 100 according to the present embodiment includes: an operation unit 400 for receiving an option signal (Option_S) including information associated with a first driving mode (forward operation) and a second driving mode (reverse operation) and outputting an enable signal; and a reset signal generating unit 401 for outputting a reset signal (RESET) in response to an enable signal (EN) output from the operation unit 400. The "option signal" (Option_S) may be referred to as a "driving mode selection signal," as this signal indicates a selected driving mode of the display device 100. The operation unit 400 may be referred to as a "driving mode selection circuit," as the operation unit 400 may be a circuit that causes the reset generation unit 401 to output a reset signal corresponding to a selected driving mode, based on the received driving mode selection signal. The reset signal generating unit 401 may be referred to as a "reset signal generator."

The reset circuit 170 according to the present embodiments may be disposed in the controller 140, or may be disposed independently from the controller 140. The option signal (Option_S) may include first driving mode (forward operation) information or second driving mode (reverse operation) information. That is, the option signal (Option_S) includes information that indicates a driving mode (e.g., forward operation, reverse operation, etc.) for operating the display device 100.

In one or more embodiments, the option signal may include information for pausing a displayed image, which may be another driving mode of the display device.

For example, the display device may be operated in the first driving mode (forward operation) when the option signal (Option_S) is "high", and the display device may be operated in the second driving mode (reverse operation) when the option signal (Option_S) is "low", and vice versa.

The operation unit 400 may perform an operation based on the received option signal (Option_S). The option signal (Option_S) may indicate an operation of the display device 100 according to a predetermined driving mode, which may be indicated by the option signal (Option_S) being "high", "low", "high-to-low", "low-to-high", etc. The operation unit 400 may generate an enable signal (EN) based on the received option signal (Option_S).

The reset signal generating unit 401 generates a reset signal (RESET) in response to the enable signal (EN) generated by the operation unit 400, and controls the operations of the compensation unit 300 and the controller 140 of FIG. 3A based on the generated reset signal (RESET).

Also, the reset signal generating unit 401 may adjust a point in time for supplying a source voltage (Vcc) to control a point in time for outputting a reset signal (RESET) generated by the reset signal generating unit 401.

Figure 5:
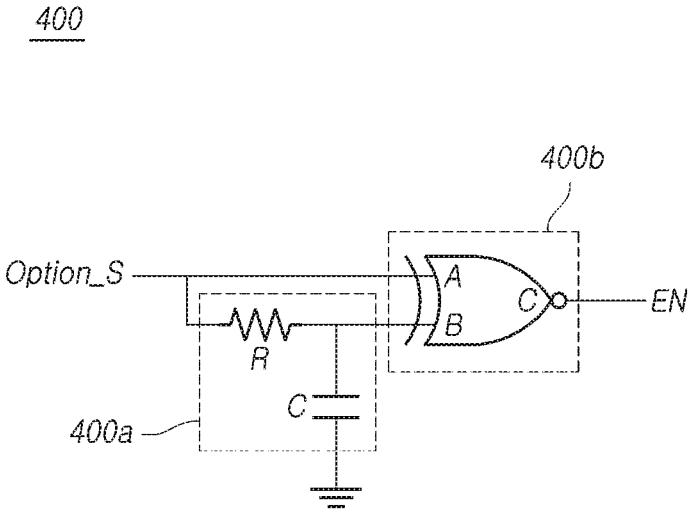
FIG. 5 is a circuit diagram illustrating the structure of an operation unit of a reset circuit according to embodiments of the present disclosure.
Figure 7A:
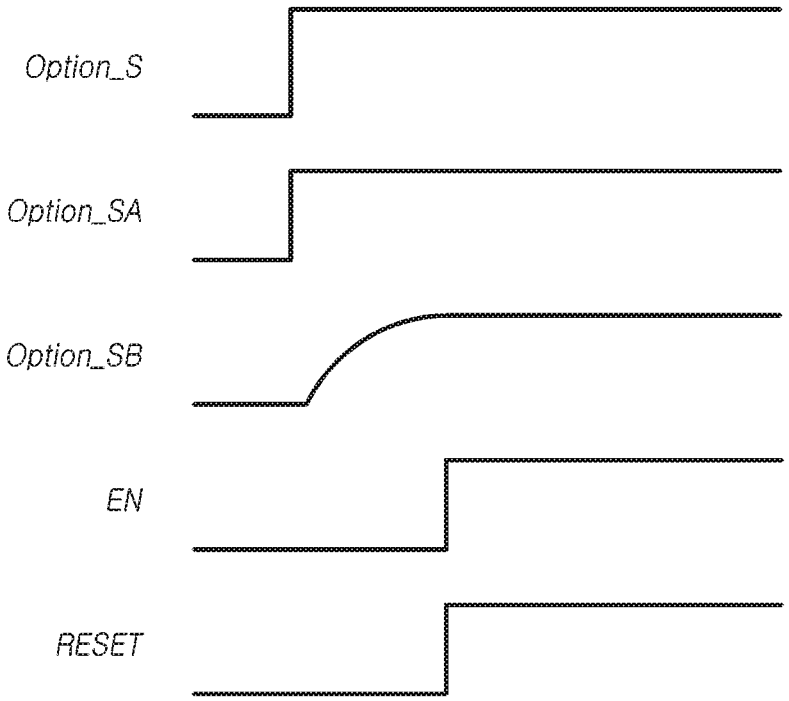
FIGS. 7A to 7C are timing diagrams illustrating an option signal supplied to a reset circuit and the operation of the reset circuit according to embodiments of the present disclosure.
Figure 7B:
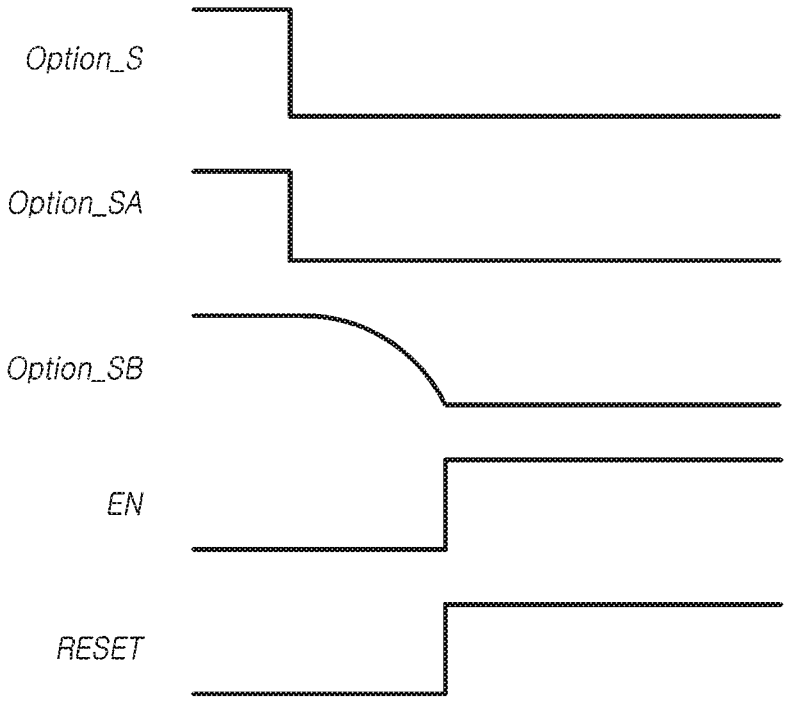
Figure 7C:
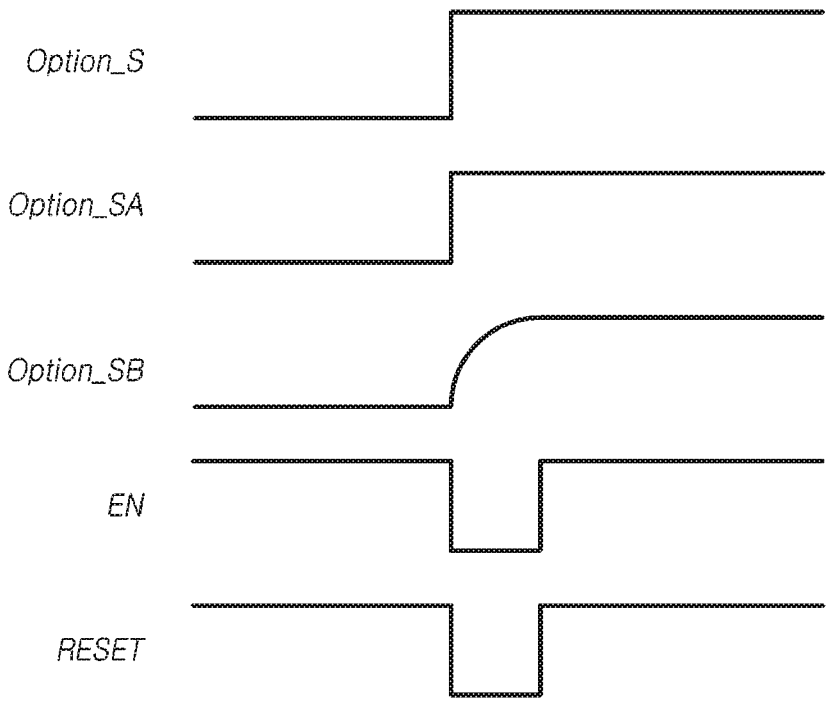

FIG. 5 is a circuit diagram illustrating the structure of an operation unit of a reset circuit according to embodiments of the present disclosure. FIG. 6 is a diagram illustrating a logical value of an operator disposed in an operation unit of a reset circuit according to embodiments of the present disclosure. FIGS. 7A to 7C are timing diagrams illustrating an option signal supplied to a reset circuit and the operations of the reset circuit according to embodiments of the present disclosure.

Referring to FIG. 5, the operation unit 400 of a reset circuit according to the present embodiment includes a signal delaying unit 400*a* for controlling a delay of an input option signal (Option_S), and an operator 400*b* for performing a logical operation on an option signal (Option_S) and a delayed option signal that passes through the signal delaying unit 400*a*. The signal delaying unit 400*a* may be referred to as a "signal delaying circuit," and the operator 400*b* may be referred to as a "logical operator."

The signal delaying unit 400*a* may include a resistor (R) and a capacitor (C), and the operator 400*b* may be a logic element, such as a XNOR gate.

The option signal (Option_S) may be an initial "low" (second driving mode) or "high" (first driving mode) state signal, and may be changed from the initial "low" state signal to a "high" state signal or from the initial "high" state signal to a "low" state signal.

That is, the option signal (Option_S) may be changed from the first driving mode to the second driving mode, or may be changed from the second driving mode to the first driving mode.

Referring to FIGS. 5 and 7A, when the option signal (Option_S) is supplied as an initial "high" state signal, a "high" signal is input to a first input end (A) of the operator 400*b* (Option_SA), and a "high" state signal is input to a second input end (B) (Option_SB) after a delay as the signal passes through the signal delaying unit 400*a*.

That is, a "high" signal is input to each of the first and second input ends (A and B) of the operator 400*b* (e.g., in a first driving mode, which may be a forward operation), and a "high"-level enable signal (EN) is output from an output end (C) of the operator 400*b* based on a logical operation value of the operator 400*b*, for example, as shown in FIG. 6.

The "high"-level enable signal (EN) output from the operation unit 400 of the reset circuit 170 is supplied to the reset signal generating unit 401, and thus, the reset signal generating unit 401 outputs a "high"-level reset signal (RESET).

Therefore, in the display device, a reset signal (RESET) corresponding to the first driving mode (the forward operation) is generated, and the reset signal (RESET) is supplied to the compensation unit 300 of FIG. 3A. Accordingly, the compensation unit 300 reads forward compensation data (C_Data) from the memory 301, and supplies the same to the controller 140. The controller 140 may display a forward image (a first driving mode operation) on a display panel using the forward compensation data (C_Data).

Referring to FIGS. 5 and 7B, when the option signal (Option_S) is an initial "low" state signal, a "low" signal is input to the first input end (A) of the operator 400*b* (Option_SA) and a "low" signal is input to the second input end (B) (Option_SB) after a delay as the signal passes through the signal delaying unit 400*a* (e.g., in a second driving mode, which may be a reverse operation).

That is, a "low" signal is input to each of the first and second input ends (A and B) of the operator 400*b*, and a "high"-level enable signal (EN) is output from the output end (C) of the operator 400*b* based on a logical operation value as shown in FIG. 6.

The "high"-level enable signal (EN) output from the operation unit 400 of the reset circuit 170 is supplied to the reset signal generating unit 401, and thus, the reset signal generating unit 401 outputs a "high"-level reset signal (RESET).

Therefore, in the display device, a reset signal (RESET) corresponding to the second driving mode (the reverse operation) is generated, and the reset signal (RESET) is supplied to the compensation unit 300 of FIG. 3A. Accordingly, the compensation unit 300 reads reverse compensation data (C_Data) from the memory 301, and supplies the same to the controller 140. The controller 140 may display a reverse image (a second driving mode operation) on the display panel using the reverse compensation data (C_Data).

Also, referring to FIGS. 5 and 7C, when an option signal (Option_S), which has been supplied as an initial "low" state signal, is changed to a "high" state signal (e.g., indicating a switch from the second driving mode to the first driving mode), the first input end (A), which directly receives the option signal (Option_S), is supplied with a "low-to-high" state signal, and the second input end (B) is supplied with a "low" state signal, which is the same as the existing signal, due to the signal delaying unit 400*a*. That is, due to the delay through the signal delaying unit 400*a*, the second input end (B) of the operator 400*b* continues to receive a "low" signal for some delay period, while the signal transitions from a "low" to "high" state as the signal passes through the signal delaying unit 400*a*.

Therefore, at a point in time when the option signal (Option_S) is changed from "low" to "high", a "high" signal is input to the first input end (A) of the operator 400*b* (Option_SA), and a "low" signal is input to the second input end (B) (Option_SB), and thus, the output end (C) of the operator 400*b* outputs a "low"-level enable signal (EN) according to a logical operation value as shown in FIG. 6.

The "low"-level enable signal (EN) output from the operation unit 400 of the reset circuit 170 is supplied to the reset signal generating unit 401, and thus, the reset signal generating unit 401 outputs a "low"-level reset signal (RESET) for some period of time, e.g., while the "low" signal is input to the second input end (B).

However, after the option signal (Option_S) is changed to a "high" state, and after the signal input to the second input end (B) (Option_SB) transitions from the "low" state to the "high" state, a "high" signal is input to each of the first and second input ends (A and B) of the operator 400*b*, and thus the output end (C) outputs a "high" level enable signal (EN).

Similarly, when the option signal (Option_S) is changed from the "high" state to the "low" state (e.g., indicating a switch from the first driving mode to the second driving mode), the first input end (A) receives the "low" state signal (Option_SA) as soon as the option signal (Option_S) changes to the "low" state; however, the signal delaying unit 400*a* delays the transition from the "high" state to the "low" state in the signal (Option_SB) received at the second input end (B). During this delay period, the second input end (B) continues to receive a "high" signal, and the operator 400*b* thus outputs a "low"-level enable signal (EN) in accordance with a logical operation value as shown in FIG. 6. The "low"-level enable signal (EN) output from the operation unit 400 of the reset circuit 170 is supplied to the reset signal generating unit 401, and thus, the reset signal generating unit 401 outputs a "low"-level reset signal (RESET).

That is, when the option signal (Option_S) is changed from a "low" state to a "high" state, or from a "high" state to the "low" state, the reset circuit according to the present embodiments outputs a secondary reset signal (RESET) at a point in time of the switch between low and high states, thereby switching a driving mode of the display device.

Therefore, according to embodiments of the present disclosure, while the compensation unit 300 of FIG. 3A reads forward compensation data as a forward operation (a first driving mode) is performed, a reverse operation (a second driving mode) can be performed. Accordingly, the compensation unit 300 may read reverse compensation data located at an address different from that of the forward compensation data and may drive the display device.

As described above, the display device according to the present embodiments is capable of switching to driving in another driving scheme in the middle of driving in a predetermined scheme, and may thus improve a stain and a color difference occurring in a displayed image by changing a driving scheme.

Figure 8:
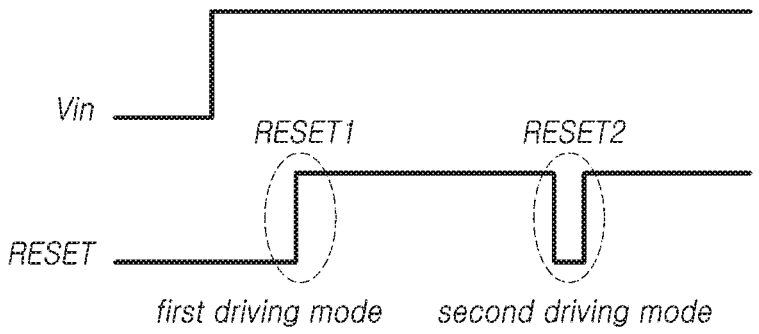
FIG. 8 is a timing diagram illustrating an operation waveform of another reset circuit according to embodiments of the present disclosure.

FIG. 8 is a diagram illustrating an operation waveform of another reset circuit according to the present embodiments.

Referring to FIG. 8, when a main power (VIN) is supplied to a display device and a source voltage (Vcc) is supplied to a reset circuit, the reset circuit according to the present embodiments generates a first reset signal (RESET1) for a forward operation corresponding to a first driving mode, and generates a second reset signal (RESET2) according to the operations of the reset circuit, which have been described with respect to FIGS. 5 and 7C, without turning off the source voltage (Vcc) or a controller.

Therefore, according to the present embodiments, the display device may switch to another driving mode in the middle of the operation in a predetermined driving mode, thereby improving the quality of a displayed image and satisfying the needs of customers.

Figure 9:
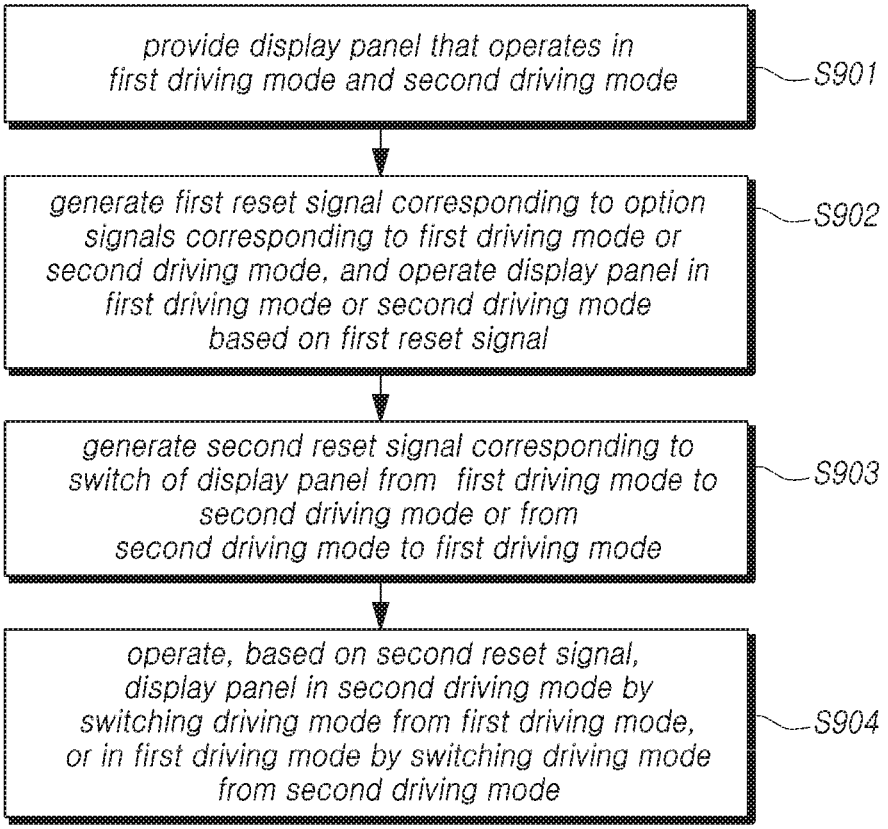
FIG. 9 is a flowchart illustrating a driving method of a display device according to embodiments of the present disclosure.

FIG. 9 is a flowchart illustrating a driving method of a display device according to the present embodiments.

Referring to FIG. 9, a method of driving a display device according to embodiments of the present disclosure may include, at S901, providing a display panel that operates in a first driving mode and a second driving mode in operation. The first driving mode may be, for example, a forward operation of the display panel, and the second driving mode may be, for example, a reverse operation of the display panel. In one or more embodiments, the display panel may be operable in additional driving modes, including, for example, a pause operation.

At S902, the method includes generating a first reset signal corresponding to option signals corresponding to the first driving mode or the second driving mode, and operating the display panel in the first driving mode or the second driving mode based on the first reset signal. That is, the first reset signal is generated, e.g., by the reset circuit 170, based on a received option signal (Option_S), which corresponds to a particular driving mode, e.g., a first or a second driving mode. The display panel is then operated in the driving mode indicated by the received option signal (Option_S), based on the first reset signal.

At S903, the method includes generating a second reset signal corresponding to a switch of the display panel from the first driving mode to the second driving mode or from the second driving mode to the first driving mode. The switch of the display panel between the first and second driving modes may be indicated by a change of the received option signal (Option_S), e.g., from "high" to "low" or from "low" to "high."

At S904, the method includes operating, based on the second reset signal, the display panel in the second driving mode by switching a driving mode from the first driving mode to the second driving mode, or operating, based on the second reset signal, the display panel in the first driving mode by switching a driving mode from the second driving mode to the first driving mode. That is, the second reset signal causes the operation of the display panel to switch from either of the first or second driving modes to the other of the first and second driving modes.

Also, in the method of driving the display device according to the present embodiments, the first driving mode may be a forward operation in which an image displayed on the display panel is a normal state, and the second driving mode may be a reverse operation in which the image displayed on the display panel is upside down with respect to the forward operation. The method includes an operation in which the display panel is switched to the second driving mode or the first driving mode based on the second reset signal in the state in which the display panel maintains the first driving mode or the second driving mode based on the first reset signal.

A reset circuit, a display device, and a driving method thereof according to the present embodiments may enable the display device to switch to the second driving mode in the middle of the operation in the first driving mode or to switch to the first driving mode in the middle of the operation in the second driving mode, thereby improving a stain and a color difference of a displayed image.

Also, a reset circuit, a display device, and a driving method thereof according to the present embodiments may generate a secondary reset signal that enables the display device to switch to another driving mode in the middle of the operation in a predetermined driving mode, thereby improving a poor image quality provided in the predetermined driving mode through the another driving mode.

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A reset circuit for a display device, comprising:

a source voltage that provides voltage to the reset circuit;

a driving mode selection circuit that, in operation, receives a driving mode selection signal corresponding to at least one of a first driving mode and a second driving mode of the display device, and outputs an enable signal based on the driving mode selection signal, the driving mode selection circuit outputs the enable signal in response to a switch in the operation of the display device from one of the first driving mode and the second driving mode to the other of the first driving mode and the second driving mode, wherein the enable signal enables a reset signal to be generated that causes the display device to switch from a first driving mode to a second driving mode; and a reset signal generator that, in operation, generates the reset signal based on the enable signal output from the driving mode selection circuit, wherein the reset signal causes a controller to control a display panel of the display device in at least one of a first driving mode and a second driving mode, the reset signal being output in synchronization with the enable signal and being generated independently from the source voltage, wherein the source voltage maintains a logical "high" signal during a value change of the reset signal, wherein the driving mode selection circuit includes:

a signal delaying circuit that receives the driving mode selection signal and outputs a delayed driving mode selection signal; and a logical operator having a first terminal that receives the driving mode selection signal, and a second terminal that receives the delayed driving mode selection signal, the logical operator performs a logical operation based on the driving mode selection signal and the delayed driving mode selection signal, and outputs the enable signal based on the logical operation, wherein the signal delaying circuit includes a resistor and a capacitor, the resistor having a first terminal coupled to the driving mode selection signal and a second terminal coupled to the capacitor and to the second terminal of the logical operator.

2. The reset circuit of claim 1, wherein the logical operator is an exclusive NOR (XNOR) logic gate.

3. The reset circuit of claim 1, wherein the driving mode selection signal corresponds to the first driving mode when the driving mode selection signal is a logical "high" and the driving mode selection signal corresponds to the second driving mode when the driving mode selection signal is a logical "low", and the reset signal generator generates a first reset signal change as a first logical "high" signal corresponding to operation of the display device in either one of the first driving mode or the second driving mode.

4. The reset circuit of claim 3, wherein, when the display device is switched from the first driving mode to the second driving mode, or from the second driving mode to the first driving mode, the reset signal generator generates a second reset signal change as a second logical "high" signal.

5. The reset circuit of claim 4, wherein the reset signal generator receives the source voltage, and the source voltage is maintained at a same voltage level during generation of the first and the second reset signal changes by the reset signal generator.

6. A display device, comprising:

a display panel;

a reset circuit including:

a driving mode selection circuit configured to receive a driving mode selection signal corresponding to an operation of the display panel in at least one of a first driving mode and a second driving mode, and to output an enable signal based on the driving mode selection signal, wherein the enable signal enables a reset signal to be generated that causes the display device to switch from the first driving mode to the second driving mode; and a reset signal generator configured to generate the reset signal in response to the enable signal output from the driving mode selection circuit, wherein the reset signal causes a controller to control the display panel of the display device in at least one of the first driving mode and the second driving mode, the reset signal being output in synchronization with the enable signal and being generated independently from a source voltage; and the controller connected to the reset circuit;

the reset circuit configured to:

receive the source voltage that provides voltage to the reset circuit, generate a first reset signal change corresponding to the operation of the display panel in one of the first driving mode or the second driving mode, generate a second reset signal change corresponding to a switch from the first driving mode to the second driving mode, or corresponding to a switch from the second driving mode to the first driving mode, maintain a logical "high" signal for the source voltage of the reset circuit during a switch operation of a logical state of the first reset signal change and the second reset signal change, and provide the first and the second reset signal changes to the controller to control the operation of the display panel in the first driving mode and the second driving mode, wherein the driving mode selection circuit includes:

a signal delaying circuit that receives the driving mode selection signal and outputs a delayed driving mode selection signal; and a logical operator having a first terminal that receives the driving mode selection signal, and a second terminal that receives the delayed driving mode selection signal, the logical operator performs a logical operation based on the driving mode selection signal and the delayed driving mode selection signal, and outputs the enable signal based on the logical operation, wherein the signal delaying circuit includes a resistor and a capacitor, the resistor having a first terminal coupled to the driving mode selection signal and a second terminal coupled to the capacitor and to the second terminal of the logical operator.

7. The display device of claim 6, further comprising: a compensation circuit coupled to the reset circuit and to the controller, the compensation circuit configured to receive the first and the second reset signal changes, and to supply compensation data corresponding to the first driving mode or the second driving mode to the controller in response to the received first and second reset signal changes.

8. The display device of claim 7, further comprising a computer-readable memory that stores first compensation data associated with the first driving mode and second compensation data associated with the second driving mode, and the compensation circuit selectively supplies one of the first compensation data and the second compensation data to the controller, based on the first and the second reset signal changes.

9. The display device of claim 6, wherein the logical operator is an exclusive NOR (XNOR) logic gate.

10. The display device of claim 6, wherein the driving mode selection signal corresponds to operation of the display panel in the first driving mode when the driving mode selection signal is a logical "high" and the driving mode selection signal corresponds to operation of the display panel in the second driving mode when the driving mode selection signal is a logical "low", and the reset signal generator generates the first reset signal change as a first logical "high" signal corresponding to operation of the display panel in either one of the first driving mode or the second driving mode.

11. The display device of claim 10, wherein, when the display panel is switched from the first driving mode to the second driving mode, or from the second driving mode to the first driving mode, the reset signal generator generates the second reset signal change as a second logical "high" signal, and enables the controller to control the display panel in a different driving mode.

12. The display device of claim 11, wherein the reset signal generator receives a source voltage, and the source voltage is maintained at a same voltage level during generation of the first and the second reset signal changes by the reset signal generator.

13. The display device of claim 6, wherein the first driving mode is a forward operation in which an image is displayed on the display panel in a first state, and the second driving mode is a reverse operation in which the image is displayed on the display panel in a second state, the second state having an orientation that is upside down with respect to the first state.

* * * * *